US005308003A

United States Patent [19]

Koenig

[11] Patent Number: 5,308,003

[45] Date of Patent: May 3, 1994

[54] ROTARY AUGER SCREW CARTRIDGE

[76] Inventor: Larry E. Koenig, 4585 Vista Dr., Canal Winchester, Ohio 43110

[21] Appl. No.: 992,555

[22] Filed: Dec. 18, 1992

[51] Int. Cl.[5] ..... B02C 19/22

[52] U.S. Cl. ..... 241/260.1; 241/DIG. 38

[58] Field of Search ..... 241/260.1, DIG. 38; 425/207, 208; 384/477; 198/672

[56] References Cited

U.S. PATENT DOCUMENTS

| | | | |
|---|---|---|---|
| 4,253,615 | 3/1981 | Koenig | 241/260.1 X |
| 4,915,308 | 4/1990 | Koenig | 241/260.1 X |
| 4,931,884 | 8/1990 | Koenig | 241/260.1 X |
| 4,938,426 | 7/1990 | Koenig | 241/260.1 X |
| 4,993,649 | 2/1991 | Koenig | 241/260.1 X |

*Primary Examiner*—Douglas D. Watts
*Attorney, Agent, or Firm*—Thompson, Hine and Flory

[57] ABSTRACT

A rotary auger of the type having a grinding chamber with a rear bulkhead separating the chamber from an equipment enclosure in which the housing for the bearing which supports the auger within the grinding chamber is removably mounted on an outboard face of the bulkhead such that the entire bearing housing, bearing, auger motor and screw may be removed from the bulkhead opening which receives the bearing housing. Consequently, it is not necessary for access to the grinding chamber, which may contain toxic or other hazardous material, to effect mounting or removal of the bearing housing, bearing, motor or auger screw. Accordingly, the bearing housing, bearing, auger motor and auger screw are structured as a cartridge which is mountable on the bulkhead. In a preferred embodiment, the bearing housing includes an outer member which is attached to the bulkhead and extends about the inner periphery of the opening in the bulkhead for receiving the cartridge. This single component is closely toleranced with the opening to eliminate the need for seals or purging lubrication between the bulkhead and outer member.

12 Claims, 3 Drawing Sheets

ROTARY AUGER SCREW CARTRIDGE

BACKGROUND OF THE INVENTION

The present invention relates to auger machines and, more particularly, to auger machines having large auger screws cantilevered within a grinding chamber and supported by a bearing assembly mounted on a bulkhead.

With certain types of grinding and shredding machines, also known as auger shredders, it is desirable to mount the shredding element, which may be a tapered screw, within a grinding chamber of the machine so that it is cantilevered from a wall or bulkhead to extend substantially horizontally within the grinding chamber. An example of such a device is shown in Koenig U.S. Pat. No. 4,253,615, which shows a single auger screw mounted within a grinding chamber. Koenig U.S. Pat. No. 4,938,926 shows an auger shredder having two opposing screws, positioned side by side, within a grinding chamber. With the latter patent, the screws are mounted on opposing bulkheads.

In each device, the auger screw is mounted on the drive shaft of a rotary hydraulic motor and is supported by the inner race of a bearing whose outer race is mounted on the outboard face of the bulkhead. An example of such structure is shown in Koenig U.S. Pat. No. 4,951,884. That patent shows an auger shredder having an auger screw mounted on a bearing disk and a motor drive shoe. The bearing disk is attached to the inner or rotational race of the main bearing, while the outer or stationary race is attached to a mounting ring which, in turn, is attached to a cylindrical extension from the outboard face of the bulkhead.

In order to remove the bearing in such a device for maintenance or repair, it is necessary for workers to enter the grinding chamber to remove such components as a bearing shield, which may be a segmented ring mounted on the bearing disk which overlaps and fits within an annular rabbet machined into the inboard face of the bulkhead to form a labyrinth between the rotating bearing disk and non-rotating bulkhead. Within the outer bearing shield is an inner bearing shield, also a segmented ring, which is mounted on the bulkhead and also must be removed to effect removal of the bearing assembly.

Accordingly, there is a need for a bearing design which enables removal of the auger screw, bearing and drive motor from the outboard side of the bulkhead, thereby eliminating the need for entry into the grinding chamber.

SUMMARY OF THE INVENTION

The present invention is a rotary auger screw cartridge in which the auger motor, bearing and bearing housing are integral with the cartridge and the entire cartridge is removably mountable on the outboard face of a bulkhead. In a preferred embodiment, the bearing housing includes an outer housing element which has an annular boss that engages the inner periphery of the bulkhead opening. The engagement of the stationary outer bearing housing element and bulkhead eliminates the need for gaskets or other seals which would otherwise be required if the seam between the cartridge and bulkhead was comprised of rotating and non-rotating components. Consequently, the outer bearing housing member is mounted on the bulkhead by a ring of cap screws which are threaded into corresponding holes formed in the bulkhead. These screws are removed easily from the outboard side of the bulkhead and do not require entry into the grinding chamber of the auger shredder to effect removal of the cartridge.

Also in the preferred embodiment, the seam between the stationary outer bearing housing and rotating inner bearing disk is concentric and positioned radially inwardly of the seam between the bulkhead and outer bearing housing member. Accordingly, any necessary seals and shield plates are mounted entirely on the bearing cartridge and are removed with the cartridge.

Accordingly, it is an object of the present invention to provide an auger screw cartridge for a rotary auger in which the entire cartridge is mountable on and removable from a bulkhead from the outboard side of the bulkhead; an auger screw cartridge in which the bearing housing, bearing and hydraulic motor which mounts the auger screw is contained within an integral cartridge that can be handled as a unit; an auger screw cartridge in which the cartridge and auger screw are removable as a unit from the grinding chamber, thereby eliminating the need to enter the grinding chamber to remove the auger screw from the cartridge assembly for maintenance or repair; and an auger screw cartridge which is relatively easy to maintain and is simple in design.

Other objects and advantages will be apparent from the following description, the accompanying drawing and the appended claims.

DETAILED DESCRIPTION

Figure 1:
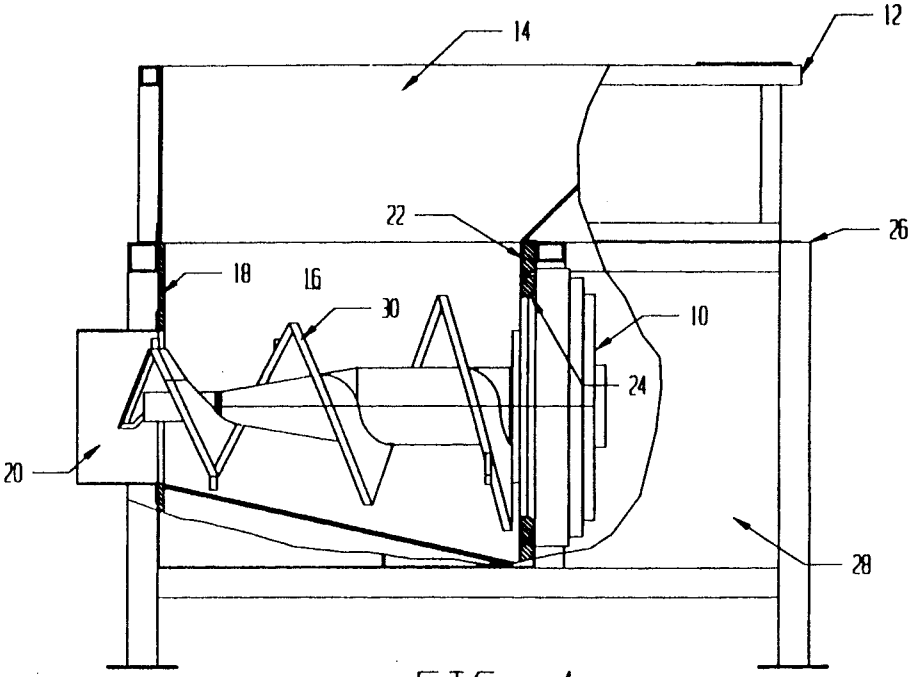
FIG. 1 is a schematic side elevation of a rotary auger incorporating a preferred embodiment of the auger screw cartridge of the present invention, in which the auger has been partially broken away to show the grinding chamber, bulkhead and equipment enclosure.

As shown in FIG. 1, the preferred embodiment of the auger screw cartridge of the present invention, generally designated 10, is shown mounted on a rotary auger, generally designated 12. The rotary auger 12 includes an inlet hopper 14 which communicates with a grinding chamber 16. The grinding chamber 16 has a front wall 18 which includes an outlet extrusion tube 20. The grinding chamber 16 also includes a rear bulkhead 22 having a central opening 24 shaped to receive the screw cartridge 10.

The inlet hopper 14 and grinding chamber 16 are supported within a frame 26 which also includes an equipment enclosure 28. The auger screw cartridge 10 supports a tapered auger screw 30 which is cantilevered into the grinding chamber 16 and is oriented substantially horizontally so that its tip protrudes into the extrusion tube 20.

Figure 2:
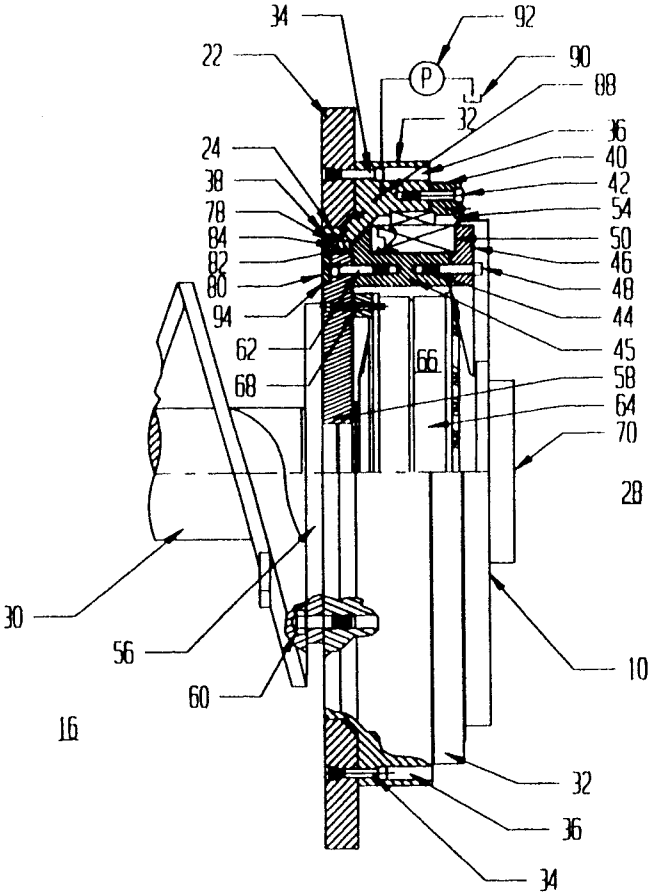
FIG. 2 is a detail side elevation in half section of the auger screw cartridge shown in FIG. 1.

As shown in FIG. 2, the cartridge 10 includes an outer bearing housing 32 which is attached to the outboard face of the bulkhead 22 by a ring of cap screws 34 that are countersunk within bores 36 and threaded into the bulkhead. Alternatively, the screws are threaded into nuts fixed within bulkhead 22. The bearing housing 32 includes an annular boss 38 which is shaped to engage the inner periphery of the opening 24 in the bulkhead 22. The outer bearing housing 32 also supports an outer clamp ring 40 which is retained by a ring of cap screws 42.

A inner bearing housing 44 is concentric with the outer bearing housing 32 and includes an inner bearing collar 45 which supports an inner clamp ring 46 which is attached by a ring of cap screws 48. Inner and outer bearing housings, 32, 44 define a bearing chamber 50 which receives the main bearing 52 of the cartridge 10. A seal 54 fills the gap between the non-rotating outer clamp ring 40 and inner clamp ring 46.

The auger screw 30 includes a disk shaped base plate 56 which is mounted on a bearing plate 58 by a ring of cap screws 60. The bearing plate 58 is substantially flush with the inboard face of bulkhead 22 and with boss 38. Plate 58 is attached to the inner bearing housing 44 by a ring of screws 62. Consequently, the auger screw 30, bearing plate 58 and inner bearing housing 44 rotate together relative to the outer bearing housing 32.

A hydraulic motor 64 is positioned within the inner bearing housing 44 and includes an outer housing 66 which is connected to the bearing plate 58 by a ring of screws 68. The inner component of the motor 64 includes an aft projecting stub 70 which is attached to a torque arm 72 (see FIG. 3) that engages aft projecting brackets 72, 74 mounted on the bulkhead 22. The torque arm 70 holds the central portion of the motor stationary, while the outer housing 66 rotates to rotate the bearing disk 58 inner bearing housing 44 and auger screw 30.

An inner bearing shield 78 is annular in shape and is mounted on the outer bearing housing 32 adjacent to the boss 38 by a ring of screws (not shown). The inner bearing shield fits within an outer bearing shield 80 which is mounted on the bearing disk 58 by a ring of cap screws (not shown). The engagement of inner and outer bearing shields 78, 80 creates a labyrinth seal to prevent the inflow of abrasive material from the grinding chamber. The outboard side of the labyrinth formed between the stationary outer bearing housing 32 and rotating bearing disk 58 is closed by a double seal 82, comprising annular spring seals. The chamber 84 formed between the seals 82 and bearing shields 78, 80 defines a grease chamber 84 which is fed through a conduit 88 from a source 90 of grease supplied by a pump 92 in a manner similar to that disclosed in U.S. Pat. No. 4,951,884 and co-pending U.S. patent application Ser. No. (Attorney Docket K1515-024), the disclosures of which are incorporated herein by reference. Grease from source 90 flows through conduit 88 to chamber 84, then through the labyrinth between shields 78, 80 to enter grinding chamber 16 at seam 94.

Figure 3:
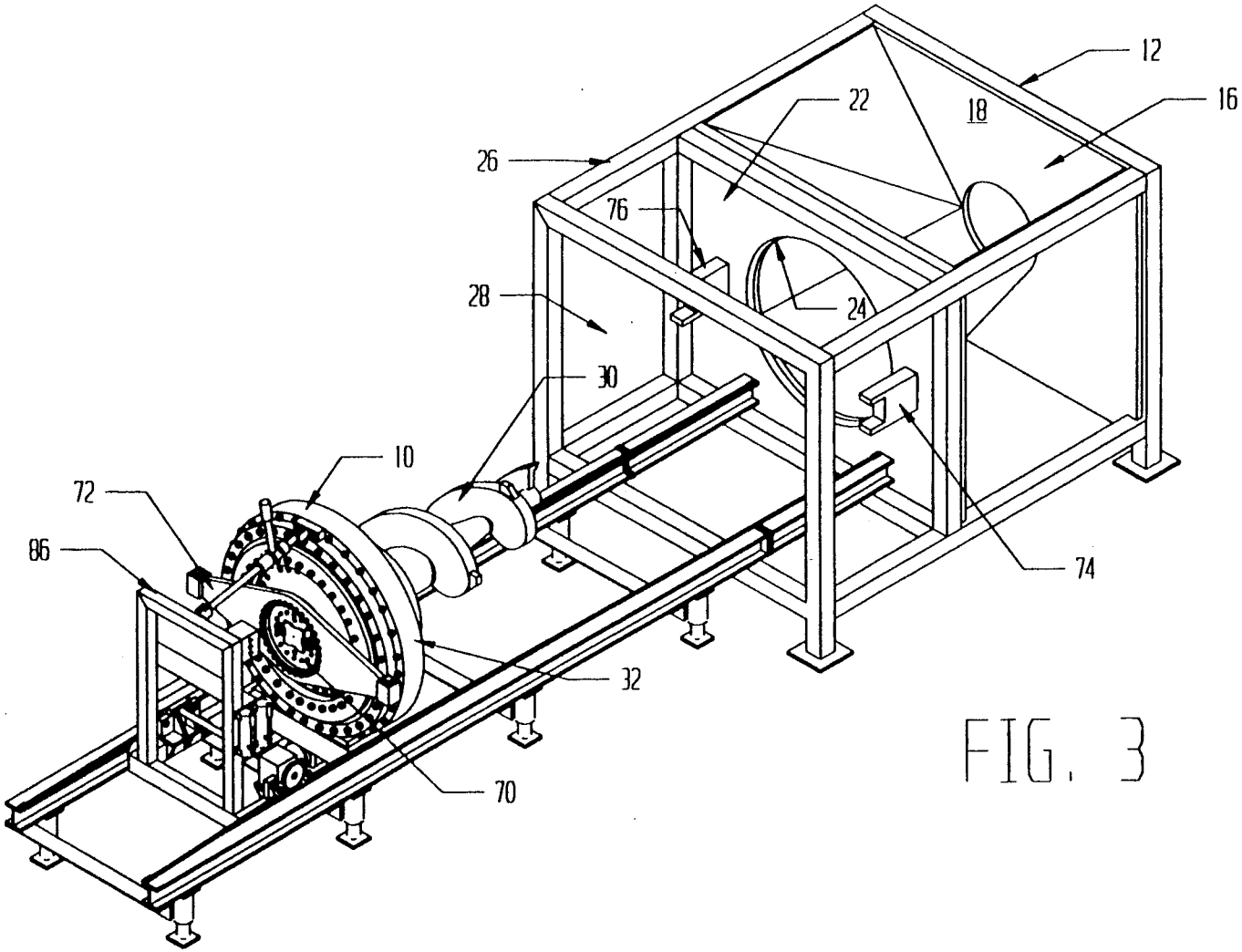
FIG. 3 is a schematic, perspective view of the auger of FIG. 1, modified to accommodate a trolley for conveying the auger screw cartridge of the present invention toward and away from the bulkhead.

As shown in FIG. 3, the cartridge 10 may be removed from the bulkhead opening 24 and transported on a trolley 86 of a type disclosed in greater detail in copending application Ser. No. (Attorney Docket K1515-017). Attachment and removal of the cartridge 10 is simply a matter of backing out cap screws 34 from the bulkhead 22, then removing the entire cartridge 10, including the auger screw 30, from the auger machine 12. Reattachment of the cartridge 10 and bearing screw 30 is effected by inserting the bearing screw through the opening 24, then reattaching the cartridge 10 by tightening down the screws 34 into the bulkhead 22. Consequently, it is not necessary for a worker to enter the grinding chamber 16 of the auger machine 12 in order to effect removal of the bearing 52, motor 66 or auger 30.

While the form of apparatus herein described constitutes a preferred embodiment of the invention, it is to be understood that other forms of apparatus may be employed without departing from the scope of the invention.

What is claimed is:

1. For use with a rotary auger having a grinding chamber, an equipment enclosure, a rear bulkhead separating said grinding chamber from said equipment enclosure and having an auger opening therethrough, bearing means, an auger screw mounted on said bearing means and extending into said grinding chamber, motor means mounted on said bearing means in said equipment enclosure for rotating said bearing and said auger screw, a cartridge assembly comprising:

an outer, stationary bearing housing attached to said bearing means and shaped to be attached to and extend about a periphery of said opening and said outer bearing housing defining an outer bearing periphery and being shaped to partially enclose said bearing means; and an inner, rotatable bearing housing attached to said bearing means and extending about said outer bearing periphery, said inner bearing housing supporting said auger screw and said motor and, together with said stationary bearing housing, substantially enclosing said bearing means; and means for removably mounting said cartridge assembly from said bulkhead, whereby said stationary bearing housing, said rotatable hearing housing and said bearing are removable from said auger as a unit through said equipment enclosure by detachment of said outer bearing housing from said bulkhead, and said bearing means is enclosed and protected by said housings when removed from said enclosure.

2. For use with a rotary auger having a grinding chamber, an equipment enclosure, a rear bulkhead separating said grinding chamber from said equipment enclosure and having an auger opening therethrough, a bearing, an auger screw mounted on said bearing and extending into said grinding chamber, motor means mounted on said bearing in said equipment enclosure for rotating said bearing and said auger screw, a cartridge assembly comprising:

an outer, stationary bearing housing attached to said bearing means and shaped to be attached to and extend about a periphery of said opening, said outer bearing housing defining an outer bearing periphery and being shaped to partially enclose said bearing;

an inner, rotatable bearing housing attached to said bearing and extending about said outer bearing periphery, said inner bearing housing supporting said auger screw and said motor and, together with said stationary bearing housing, substantially enclosing said bearing means;

means for removably mounting said cartridge assembly from said bulkhead, whereby said stationary bearing housing, said rotatable bearing housing and said bearing is removable from said auger as a unit through said equipment enclosure by detachment of said outer bearing housing from said bulkhead, and said bearing means is enclosed and protected by said housings when said cartridge is detached from said bulkhead; and seal means, extending between said outer and inner bearing housings, for preventing contaminants from flowing from said grinding chamber to said bearing.

3. The cartridge assembly of claim 2 wherein said seal means includes an outer seal segment attached to said inner bearing housing and facing said grinding chamber, and an inner seal segment attached to said outer bearing housing, said outer and inner seal segments being in overlapping relation and forming a labyrinth seal for containing lubricant.

4. The cartridge assembly of claim 3 wherein said outer bearing housing includes conduit means for conveying lubricant to said labyrinth seal.

5. The cartridge assembly of claim 4 wherein said inner bearing housing includes a bearing plate, oriented substantially flush with said bulkhead, said bearing plate being attached to said auger screw and said motor.

6. The cartridge assembly of claim 5 wherein said inner bearing housing includes an inner bearing collar attached to said bearing plate and extending rearwardly from said bulkhead.

7. The cartridge assembly of claim 6 wherein said inner bearing housing includes an inner clamp ring attached to said inner bearing collar.

8. The cartridge assembly of claim 7 wherein said bearing includes a bearing element positioned between said outer and inner bearing housings, said bearing element being engaged and captured by said inner bearing collar and said inner clamp ring.

9. The cartridge assembly of claim 8 wherein said outer bearing housing includes an outer clamp ring for clamping s id bearing element to said outer bearing housing.

10. The cartridge assembly of claim 4 wherein said outer and inner bearing housings are shaped to form a lubricant reservoir therebetween adjacent to said inner seal segment, and said bearing includes annular grease purge seal means, said grease purge seal means defining a portion of said reservoir, whereby lubricant flowing through said conduit means enters said reservoir, and from said reservoir through said labyrinth seal to said grinding chamber.

11. In a rotary auger having a grinding chamber, an equipment enclosure, and a rear bulkhead separating said grinding chamber from said equipment enclosure and including an opening therethrough, an auger screw cartridge comprising:

an auger screw projecting into said grinding chamber;

motor means for rotating said auger; and bearing means, mounted on said bulkhead, for supporting said auger screw and said motor, said bearing means including an outer bearing housing having a flange portion attached to an equipment enclosure facing side of said bulkhead and an annular boss abutting and extending about a periphery of said opening, and an inner bearing housing, rotatable relative to said outer bearing housing and including a bearing disk adjacent to said boss, said boss and said bearing disk cooperating to close said opening; and means for removably mounting said flange portion of said outer bearing housing to said equipment enclosure facing side of said bulkhead, whereby said auger screw cartridge is removable through said equipment enclosure by detaching said portion from said bulkhead.

12. For use with a rotary auger having a grinding chamber, an equipment enclosure, a rear bulkhead separating said grinding chamber from said equipment enclosure and having an auger opening therethrough, a bearing mounted on said bulkhead and sealing said opening, an auger screw mounted on said bearing and extending into said grinding chamber, motor means, mounted on said bearing in said equipment enclosure, for rotating said bearing and said auger screw, a cartridge assembly comprising:

an outer, stationary bearing housing attached to and extending about a periphery of said opening and including means for attachment for said outer bearing housing to said equipment enclosure side of said bulkhead, said outer bearing housing defining an outer bearing periphery;

an inner rotatable bearing housing attached to said outer bearing housing and extending about said outer bearing periphery, said inner bearing housing supporting said auger screw and said motor; and means for removably mounting said outer bearing housing entirely on an equipment enclosure facing surface of said bulkhead, said mounting means not requiring any attachment to the grinding chamber side of the bulkhead, whereby said bearing is removable from said auger through said equipment enclosure by detachment of said outer bearing housing from said bulkhead.

* * * * *